US005937605A

United States Patent [19]

Wendt

[11] Patent Number: 5,937,605

[45] Date of Patent: Aug. 17, 1999

[54] ADJUSTABLE FACE TRIM CLIP FOR DRYWALL SUSPENSION GRID

[75] Inventor: Alan C. Wendt, Barrington, Ill.

[73] Assignee: USG Interiors, Inc., Libertyville, Ill.

[21] Appl. No.: 09/025,272

[22] Filed: Feb. 18, 1998

[51] Int. Cl.[6] ..... E04B 9/00

[52] U.S. Cl. ..... 52/506.06; 52/506.07; 52/506.08; 52/506.09; 52/506.1; 403/119; 403/286

[58] Field of Search ..... 52/713, 712, 506.07, 52/506.08, 506.09, 506.01, 506.06; 403/393, 119, 231, 286

[56] References Cited

U.S. PATENT DOCUMENTS

| | | | |
|---|---|---|---|
| 5,195,289 | 3/1993 | LaLonde et al. | 52/506.06 |
| 5,572,844 | 11/1996 | Stackenwalt et al. | 52/506.07 |
| 5,720,571 | 2/1998 | Frobosilo | 403/231 |

OTHER PUBLICATIONS

Cover Page and Drawing No. KWO54764 entitled "AXIOM Custom Perimeter Trim Made Easy" advertising literature by Armstrong World Industries, Inc. (Drawing Revision dated Nov. 20, 1995).

*Primary Examiner*—Carl D. Friedman
*Assistant Examiner*—Dennis L. Dorsey
*Attorney, Agent, or Firm*—Lee, Mann, Smith, McWilliams, Sweeney & Ohlson

[57] ABSTRACT

The present invention is a clip used in the construction of suspension grid ceilings that are either island ceilings or ceilings having floating edges. The clip provides a versatile means for attaching face trim, such as COMPASSO™ trim, to the ceiling edge created by the suspended grid beams. The clip mounting can be vertically adjusted so that the typical trim problems of gaps or inconsistencies between the face trim and the horizontal ceiling panels may be eliminated without resorting to traditional finishing procedures. The same clip may be used in several different mounting situations involving the grid beam arranged to the trim at angles ranging from parallel to orthogonal.

15 Claims, 5 Drawing Sheets

ADJUSTABLE FACE TRIM CLIP FOR DRYWALL SUSPENSION GRID

BACKGROUND OF THE INVENTION

The present invention relates to suspended drywall ceilings that require a floating edge in their construction. Such suspended drywall ceilings are typically constructed using suspended "T" grid beams, joined to form a supporting grid system upon which drywall or lay-in acoustical panels can be mounted. This grid system is usually referred to as suspension grid. A "T" grid beam is an elongated beam with a flange at the bottom of the beam and a thicker "bulb" portion at the top end of the beam. Thus, the cross section of the beam resembles an inverted "T" shaped configuration. The bottom of the flange provides the grid face for the attachment of drywall or other panels. Typically, these grid beams are made of extruded aluminum or roll-formed steel, and can be straight or curved.

Certain suspended grid ceiling designs call for a floating edge ceiling or an island ceiling, where one or more edges of the ceiling are exposed and must be trimmed and finished. In these design situations, the suspended grid beam ends are cut to form the exposed vertical edge of the ceiling, or the edge is formed along the length of a grid beam. The current method of trimming such an edge is to wrap the edge with drywall and apply a corner bead to the lower portion of the edge and a "J" bead to the upper portion of the edge. The edge is then finished with joint compound. However, there are problems with using such conventional finishing techniques on these edges.

Trimming and finishing edges with drywall, corner bead, "J" bead and finishing compound is costly and very time consuming. Various imperfections caused by misalignment of the suspension grid beams and gaps between the beams and the drywall ceiling panels make finishing these edges difficult. Considerable time must be spent in wrapping the edge with drywall and installing the corner bead and "J" bead. After this is done, the edge must still be finished with finishing compound so that the various imperfections and misalignments can be covered and so that the surfaces forming the edge can be blended together. Having to use all of these different materials to create the finished edge is costly.

In order to reduce the cost and time involved in finishing edges with conventional techniques, edges are sometimes finished with conventional face trim, such as COMPASSO™ trim sold by USG Interiors, Inc., which may be made of roil-formed steel or extruded aluminum. This requires the use of clips, the subject of the present invention, that are attached to the grid beams and allow the face trim to be clipped to the beams. The face trim, is straight or curved to follow the edge created by the grid beams. The use of face trim eliminates the need for extra drywall, corner bead, "J" bead and finishing compound.

Prior art clips have been used to attach this face trim to ceiling edges. However, there are problems with these prior art clips. The major problem with these clips is that when a clip is attached to a grid beam, the position of the clip is fixed. This also fixes the vertical positioning of the face trim when it is attached to the clip. Therefore, if any gaps appear between the horizontal ceiling panels and the bottom of the face trim, they cannot be easily corrected. These gaps create an unsightly nonuniform appearance in the ceiling edge. The fixed positioning of these clips also creates a problem when different ceiling panel thicknesses are used. One clip design cannot accommodate different panel thicknesses.

It is therefore an object of the present invention to provide a clip for attaching face trim to suspended grid ceiling edges that is vertically adjustable with respect to the grid beam so that gaps between the bottom of the face trim and the horizontal ceiling panels can be easily eliminated.

It is also an object of the present invention to provide a clip for attaching face trim to suspended grid ceiling edges that will accommodate both ½ and ⅝ inch thick ceiling panels.

It is a further object of the present invention to provide a clip for attaching face trim to suspended grid ceiling edges that can be attached to either side of a grid beam, thus accommodating use of the clip where grid beams intersect the face trim at acute angles.

It is also an object of the present invention to provide a clip for attaching face trim to suspended grid ceiling edges that makes it easier for right handed installers to hold the clip with the left hand while securing it using the right hand.

SUMMARY OF THE INVENTION

The invention is a clip that can be fastened to suspended "T" grid beams at various points where face trim is to be attached. The clip allows the face trim, such as COMPASSO™ trim, to be clipped in place along an edge created by suspended grid. These edges usually form a floating edge in a ceiling or are the edges of an island ceiling. The clip comprises two joined parts, a trim-attaching portion and a bracket portion. The trim-attaching portion is an elongated substantially flat member that has attachment flanges formed at both ends. These attachment flanges are bent at an angle greater than 90 degrees so that they flare out and provide a clip spring force used to hold against flanges of the face trim. The trim-attaching portion also has a pivot flange formed from the flat material between the two attachment flanges. The pivot flange is bent in the same direction as the attachment flanges. The pivot flange provides for the attachment of the bracket portion of the clip.

The bracket portion is a substantially bi-planar member with a bracket flange formed along the length of a top horizontal edge. A bottom horizontal edge is bent so that it is flared out at an angle in the direction of the bracket flange. A generally bi-planar configuration extends between the top and bottom edges of the bracket portion providing a grid beam bearing formed by being bent twice along the length of the bracket portion so that offset surfaces are formed parallel to the top and bottom horizontal edges. The offset surfaces are bi-planar and are bearing surfaces for the suspended "T" grid beam when the clip is attached, namely: (1) a bulb bearing surface just below the bracket flange of the bracket portion; and (2) a web bearing surface offset from the bulb bearing surface, both surfaces being located on the opposite side of the bracket portion from which the bracket flange extends. Holes are formed through the bulb bearing surface of the bracket portion, located closer to an outer vertical edge of the bracket portion, distal from the trim-attaching portion. Vertical slots are formed through the offset web bearing surface and are horizontally aligned below the holes of the bulb bearing surface.

The bracket portion is pivotally fastened to the trim-attaching portion through the bracket flange of the bracket portion and the pivot flange of the trim-attaching portion. The bracket flange is positioned under the pivot flange such that the outer vertical edge of the bracket portion is positioned away from the trim-attaching portion. Thus, the holes and slots of the bracket portion, which are located closer to the outer vertical edge of the bracket portion, are positioned away from the pivot point. Enough space is left between the inner vertical edge of the bracket portion and an inner flat surface of the trim-attaching portion to allow clearance for the trim-attaching portion to freely pivot with respect to the bracket portion so trim can be engaged at any pivotal angle. The two portions are fastened with a fastener that allows for pivoting movement, such as a rivet.

The clip may be used at a point on a ceiling edge where a suspended "T" grid beam perpendicularly intersects the edge. In this case, the clip is positioned on the "T" grid beam such that the bulb bearing surface of the bracket portion of the clip is placed against the bulb portion of the "T" grid beam and the web bearing surface of the bracket portion of the clip is placed against the web portion of the "T" grid beam. The attachment flange on the bottom end of the trim-attaching portion of the clip fits over the horizontal ceiling panel attached to the suspended "T" grid beam. The clip is then fastened to the web portion of the "T" grid beam through one of the slots of the bracket portion of the clip, typically with sheet metal screws. The face trim, or other face trim, is shaped to follow the pre-designed contour of the ceiling edge. The face trim is then attached to the clip by clipping the flanges of the face trim over the attachment flanges on the ends of the trim-attaching portion of the clip. The face trim can be vertically adjusted with respect to the horizontal ceiling plane attached to the suspended "T" grid beam by adjusting the position of the bracket portion of the clip with respect to the "T" grid beam via the slots in the web bearing surface of the bracket portion. The bracket portion of the clip can be slid upwardly since it is fastened to the "T" grid beam through the slot by screw fasteners. This method of adjustment allows the installer to cure any gaps between the horizontal ceiling plane and the lower edge of the face trim. When proper adjustment has been achieved, the clip can be secured to the "T" grid beam by screw fastening the bracket portion of the clip to the "T" grid beam through the holes of the bulb bearing surface of the bracket portion. Since the proper position of the face trim is secure at this point, the trim can be removed during the finishing steps of the ceiling without losing the properly adjusted position. Removal of the face trim during the finishing process of the ceiling prevents damage to the trim. When the ceiling panels are installed, the trim can be re-attached.

The clip may be used at a point on the ceiling edge where the suspended "T" grid beam intersects the edge at an angle. The bracket portion is attached to the "T" grid beam and the trim-attaching portion is pivoted at the proper angle to allow the attachment of the face trim. In the cases where the angle of intersection forms an obtuse and acute angle between the clip and the face trim, the bracket portion can always be mounted to the obtuse angle side of the "T" grid beam for ease of access for the installer, thus allowing the installer to access the holes and slots of the bracket portion without tight space interference by the face trim. When tight spacing requires that the clip must be mounted on the obtuse angle side of the "T" grid beam, which is non typical, the surface on the opposite side of the bracket portion having the bulb bearing surface will bear against the bulb portion of the "T" grid beam and likewise, the surface on the opposite side of the bracket portion having the web bearing surface will face, but due to the offset, not bear against the web portion of the "T" grid beam. With the clip positioned in this manner, there is a gap between the web portion of the "T" grid beam and the offset web bearing surface of the bracket portion of the clip. In this orientation, the bracket flange of the bracket portion of the clip is positioned to extend over the bulb portion of the "T" grid beam and the flared bottom horizontal edge will bear against the web portion of the "T" grid beam. However, the vertical adjustment procedure is the same for all attachment positions.

The clip may also be used at a point along the ceiling edge where a suspended "T" grid beam runs parallel to the edge. The clip is fastened to the "T" grid beam and the trim-attaching portion of the clip is pivoted a full 90° with respect to the bracket portion of the clip so that the clip face surface of the trim-attaching portion is also parallel to the "T" grid beam. The face trim may then be clipped to the trim-attaching portion of the clip and vertically adjusted if necessary.

DETAILED DESCRIPTION OF THE INVENTION

Figure 1:
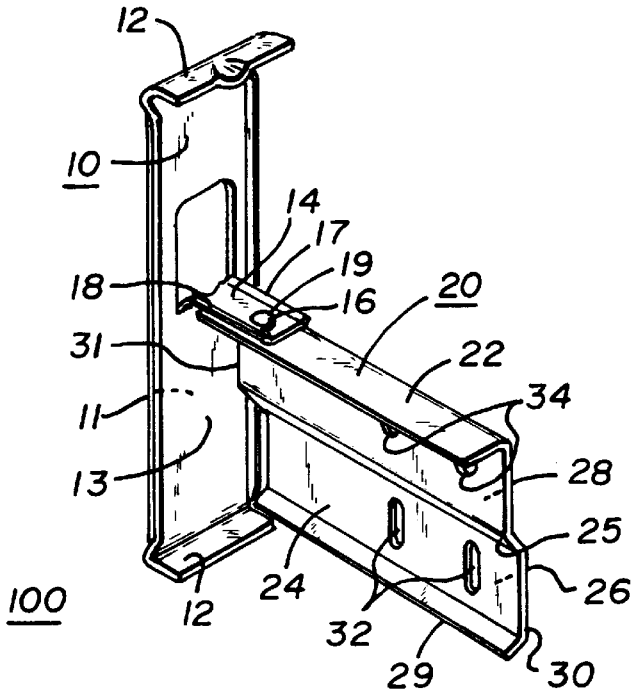
FIG. 1 is a perspective view of the clip.
Figure 11:
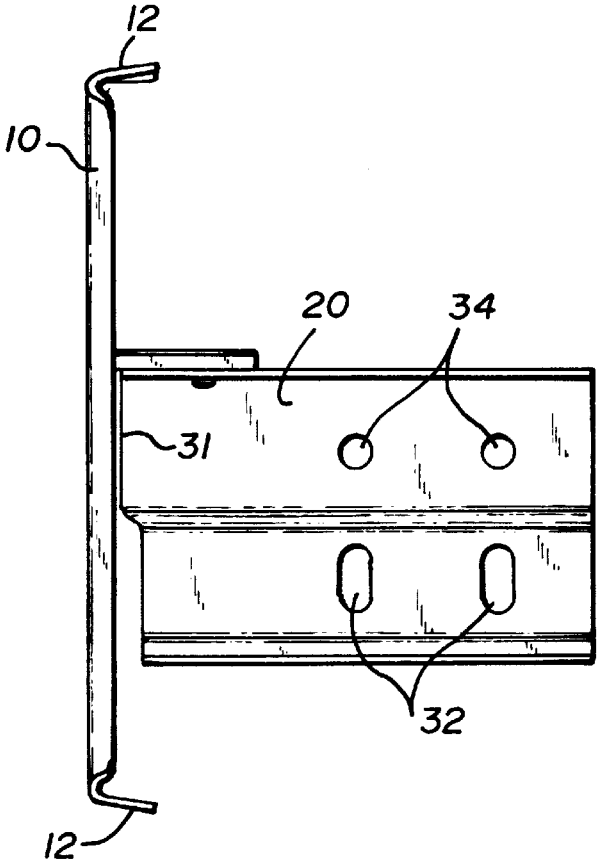
FIG. 11 is a side view of the clip of FIG. 9.

A clip 100 essentially comprises a trim-attaching portion 10 and a bracket portion 20, as depicted in FIG. 1. The clip 100 is typically formed from sheet metal. In the preferred embodiment, the clip 100 is made from 22 gauge galvanized steel. The trim-attaching portion 10 has a face surface 11 and attachment flanges 12 at each of its ends. The attachment flanges 12 are bent at an angle greater than 90 degrees with respect to the face surface 11 so that they flare out and provide a clip spring force, as shown in FIG. 11. The face surface 11 provides a bearing surface for face trim that may be attached to the clip 100, such as COMPASSO™ trim. At the opposite side from the face surface 11, the trim-attaching portion 10 has an inner surface 13. The trim-attaching portion 10 also has a pivot flange 14 formed between the two attachment flanges 12. In the preferred embodiment, the pivot flange 14 is formed by punching a "U" shaped form through the face surface 11 and bending the remaining material within the "U" shape in the direction of the attachment flanges 12.

Figure 5:
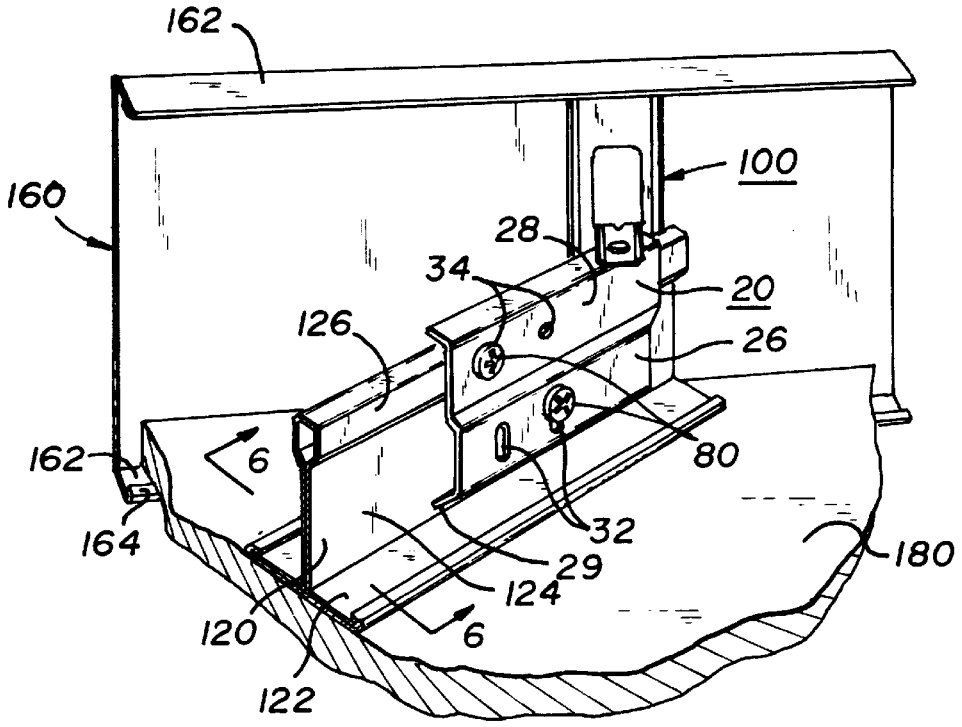
FIG. 5 is a detailed perspective view of a segment of FIG. 2 showing a clip mounted to a "T" grid beam intersecting the floating edge of the ceiling at an angle that typically requires the clip to be mounted in the reverse configuration to the "T" grid beam, thus allowing the installer to fasten the bracket portion of the clip to the "T" grid beam to the obtuse angle side of the "T" grid beam without any obstruction from the COMPASSO™ trim created by the supplemental acute angle of intersection.

The bracket portion 20 has a bracket flange 22 formed along its top horizontal edge and a bi-planar grid beam bearing portion 24. The grid beam bearing portion 24 is bent twice along the length of the bracket portion 20 at a step 25. The step 25 defines a bi-planar shape comprising two offset surfaces of the grid beam bearing portion 24 of the bracket portion 20, namely, a web bearing surface 26 and a bulb bearing surface 28. The bottom horizontal edge 29 of the bracket portion 20 is bent so that it is flared out at an angle to the same side of the bracket portion 20 as the bracket flange 22. This edge 29 provides added strength and rigidity to the bracket portion 20 and also acts as a support when the clip 100 is mounted in a reverse orientation, as shown in FIG. 5. Referring to FIG. 1, the bracket portion 20 has vertical slots 32 formed through the web bearing surface 26 of the grid beam bearing portion 24 and holes 34 formed through the bulb bearing surface 28 of the grid beam bearing portion 24. The vertical slots 32 and the holes 34 are positioned so that they are closer to an outer vertical edge 30 than an inner vertical edge 31 of the bracket portion 20. The vertical slots 32 are vertically aligned below the holes 34.

Figure 9:
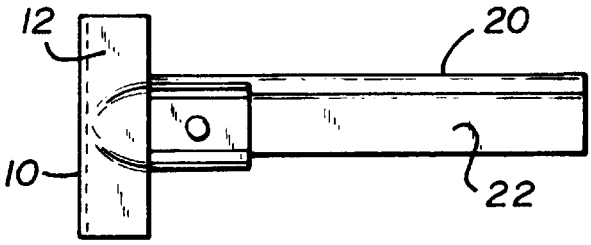
FIG. 9 is a top view of the clip of FIGS. 1–8.
Figure 10:
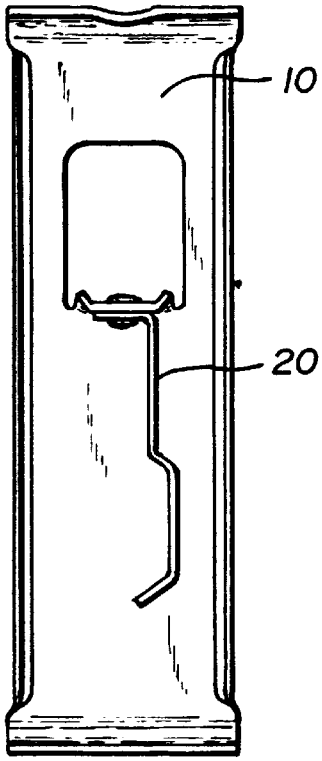
FIG. 10 is an end view of the clip of FIG. 9.

The trim-attaching portion 10 is pivotally fastened to the bracket portion 20 through the pivot flange 14 and the bracket flange 22 by a pivot fastener 16, as shown in FIG. 1. In the preferred embodiment, the pivot fastener 16 is a rivet. The bracket flange 22 is positioned under the pivot flange 14 such that the outer vertical edge 30 of the bracket portion 20 is positioned away from the trim-attaching portion 10. Thus, the holes 34 and the vertical slots 32 in the grid beam bearing portion 24 of the bracket portion 20, which are located closer to the outer vertical edge 30 than the inner vertical edge 31 of the bracket portion 20, are positioned away from the pivot connection 19. An offset space is left between the inner vertical edge 31 of the bracket portion 20 and the inner surface 13 of the trim-attaching portion 10 to allow clearance for the trim-attaching portion 10 to freely pivot with respect to the bracket portion 20. Edges 17 and 18 of the pivot flange 14 are bent upward to prevent binding between the pivot flange 14 and the bracket flange 22, and also to provide stiffness. FIGS. 9–11 show the details of the clip 100.

Figure 2:
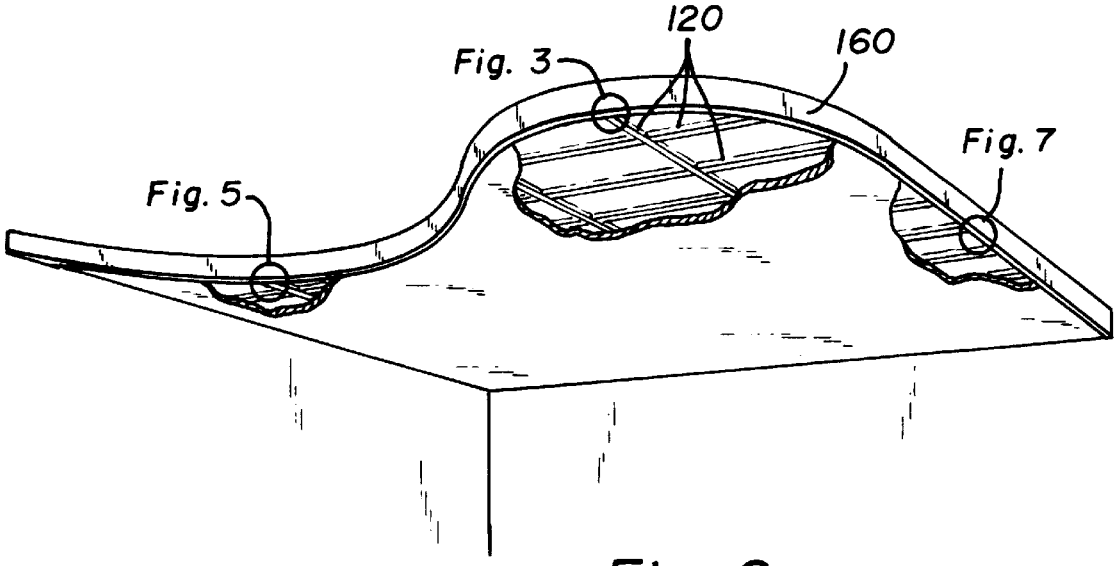
FIG. 2 is a perspective view of a suspended grid drywall ceiling having a floating edge with portions of the drywall cut away, thus exposing three different intersections between a "T" grid beam and the floating edge.
Figure 3:
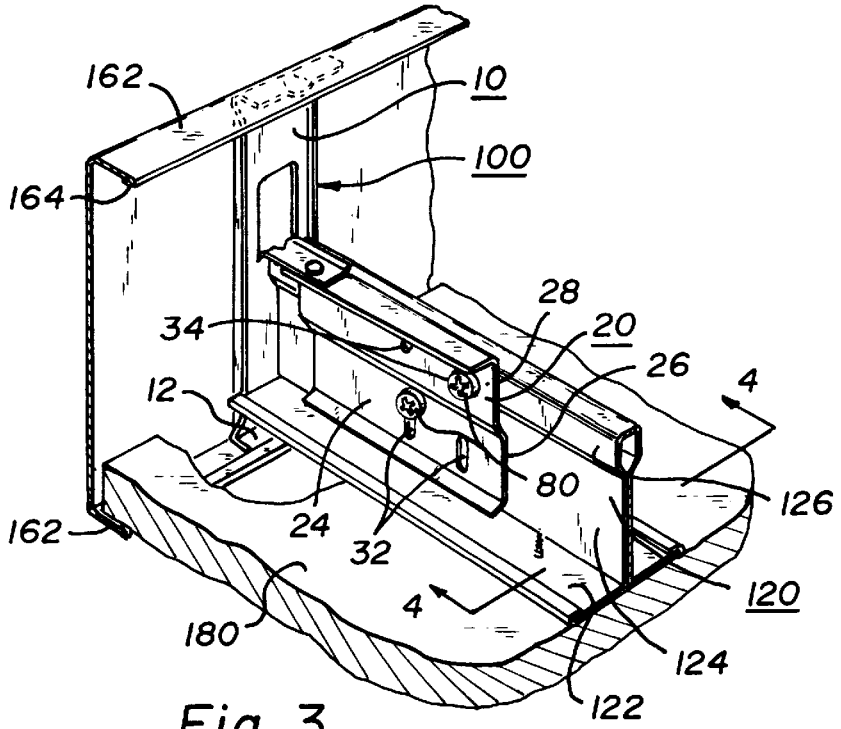
FIG. 3 is a detailed perspective view of a segment of FIG. 2 showing a clip mounted in a typical configuration to a "T" grid beam transversely intersecting the floating edge of the ceiling with COMPASSO™ trim clipped to the trim-attaching portion of the clip. A portion of the horizontal drywall panel is cut away to show the bottom attachment flange of the trim-attaching portion of the clip as it is disposed relative to the flange of the COMPASSO™ trim and the horizontally extending drywall panel.
Figure 7:
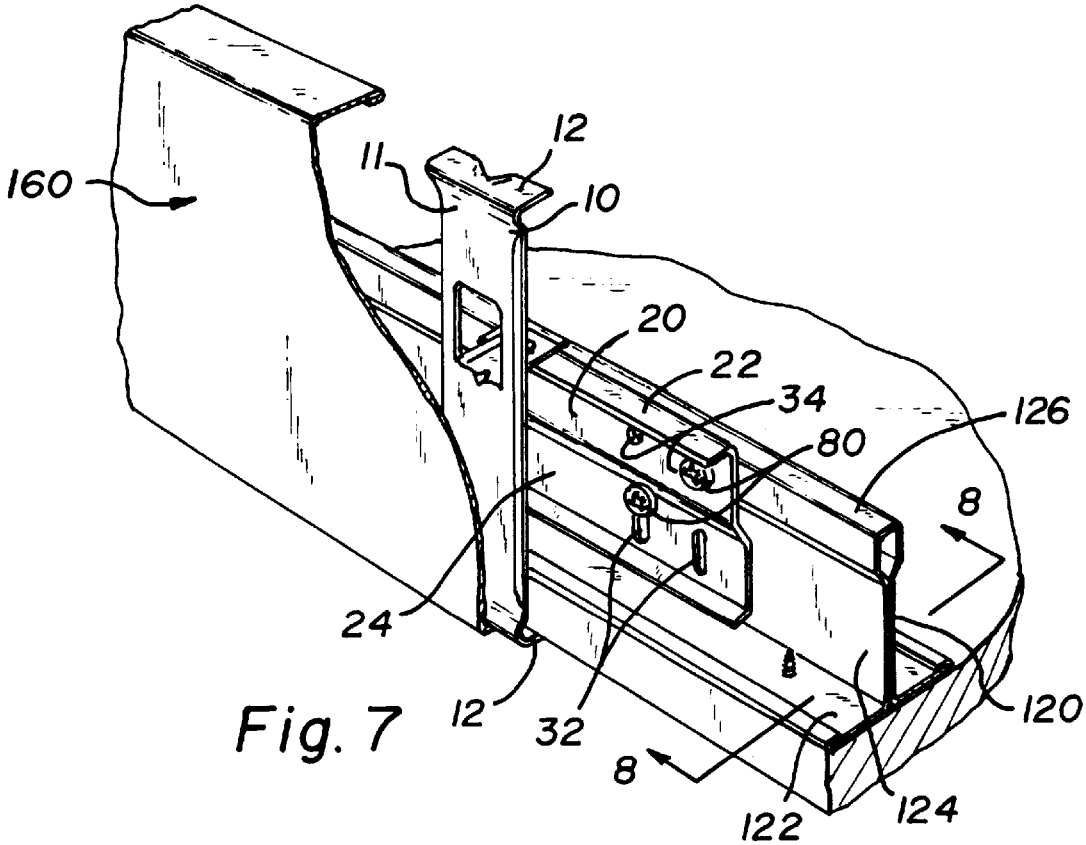
FIG. 7 is a detailed perspective view from FIG. 2 showing a clip mounted in another typical configuration to a "T" grid beam running parallel to and along the floating ceiling edge. The trim-attaching portion of the clip is pivoted so that the face surface of the trim-attaching portion of the clip is also parallel to the length of the "T" grid beam.

FIG. 2 shows a typical suspended grid drywall ceiling 200 having a floating edge finished with a COMPASSO™ trim 160. Other face trim may also be used to finish the ceiling edge. Such suspended drywall ceilings are typically constructed using suspended "T" grid beams 120, joined to form a supporting grid system upon which drywall 180 can be mounted. Referring to FIG. 3, a typical "T" grid beam 120 is an elongated beam with a flange 122 at the bottom of the beam, a center web portion 124 and a thicker "bulb" portion 126 at the top end of the beam. Thus, the cross section of the beam 120 resembles an inverted "T" shaped configuration. However, other forms of the "T" grid beam may not have a "bulb" portion. The bottom of the flange 122 provides the grid face for the attachment of drywall or other panels. FIG. 2 also shows three typical intersections encountered between "T" grid beams and the ceiling edge created by the suspended grid. FIGS. 3, 5 and 7 are detailed views of these intersections.

FIG. 3 shows a clip 100 mounted in a standard configuration to a "T" grid beam 120 perpendicularly intersecting the floating edge of the ceiling. In this configuration, the clip 100 is positioned on the "T" grid beam 120 such that the bulb bearing surface 28 of the grid beam bearing portion 24 of the bracket portion 20 is placed against the bulb portion 126 of the "T" grid beam 120 and the web bearing surface 26 of the grid beam bearing portion 24 of the bracket portion 20 is placed against the web portion 124 of the "T" grid beam 120. The bottom attachment flange 12 of the trim-attaching portion 10 of the clip 100 fits over the horizontal ceiling panel 180 attached to the flange 122 of the "T" grid beam 120. The clip 100 is then fastened to the web portion 124 of the "T" grid beam 120 through one of the vertical slots 32 of the bracket portion 20 of the clip 100, typically with a sheet metal screw 80.

Figure 8:
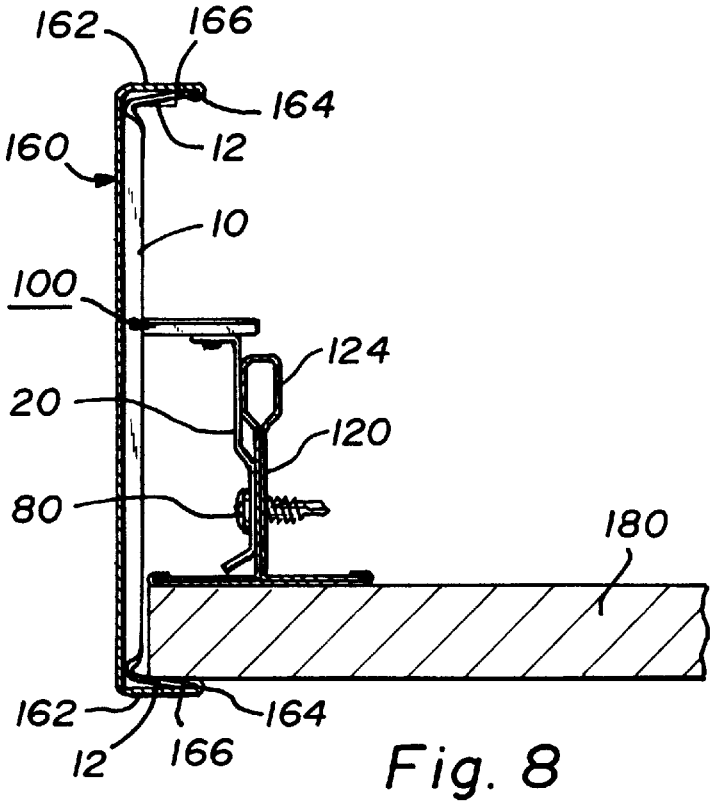
FIG. 8 is a cross-sectional end view of a "T" grid beam with the clip and COMPASSO™ trim mounted thereon, according to the mounting configuration of FIG. 7. The clip is vertically adjusted to accommodate a ⅝ inch thick drywall panel.

The COMPASSO™ trim 160, or other face trim, is shaped to follow the contour of the ceiling edge. The COMPASSO™ trim 160 has upper and lower inturned flanges 162 that run along the length of the trim. Leading edges 166 of the flanges 162, best viewed in FIG. 8, are bent back inwardly to form rebates 164. The COMPASSO™ trim 160 is mounted to the clip 100 by snapping the leading edges 166 of flanges 162 of the COMPASSO™ trim 160 over the attachment flanges 12 of the trim-attaching portion 10 of the clip 100, as shown in FIG. 8. The COMPASSO™ trim 160 is then vertically adjusted with respect to the horizontal ceiling panel 180 attached to the flange 122 of the "T" grid beam 120. This vertical adjustment is performed by adjusting the position of the bracket portion 20 of the clip 100 with respect to the "T" grid beam 120 via the vertical slots 32 in the bracket portion 20 used to fasten the clip 100. The sheet metal screw 80 can be slightly backed out in order to make this vertical adjustment. The bracket portion 20 of the clip 100 can easily be slid upwardly since it is fastened to the "T" grid beam 120 through one of the vertical slots 32. This method of adjustment allows the installer to cure any gaps between the horizontal ceiling panel 180 and the lower flange 162 of the COMPASSO™ trim 160. When proper adjustment has been achieved, the clip 100 can be secured to the "T" grid beam 120 by fastening the bracket portion 20 of the clip 100 to the "T" grid beam 120 through one of the holes 34 in the bracket portion 20. Since the proper position of the COMPASSO™ trim 160 may be secured at this point in the installation process, the COMPASSO™ trim 160 can be removed during the finishing steps of the ceiling without losing the properly adjusted position. Removal of the COMPASSO™ trim 160 during the finishing process of the ceiling prevents any possible damage that may occur from taping, sanding, painting, etc. When the ceiling is finished, the COMPASSO™ trim 160 can be reinstalled.

Figure 4A:
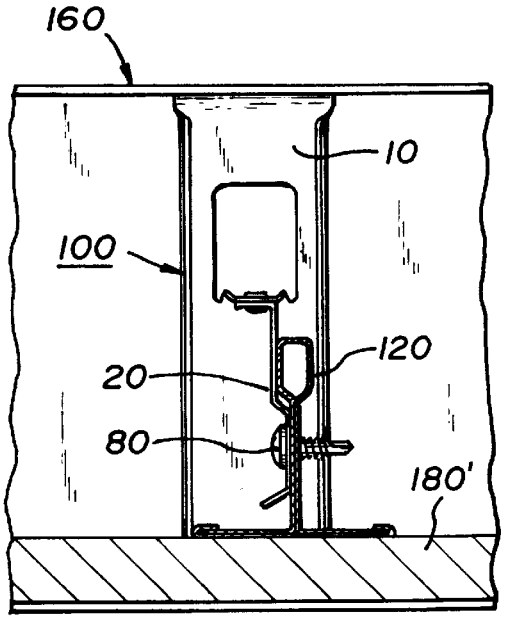
FIG. 4*a* is a cross-sectional end view of a "T" grid beam with the clip and the COMPASSO™ trim mounted thereon, according to the mounting configuration of FIG. 3. The clip is shown vertically adjusted on the "T" grid beam to accommodate a ½ inch thick drywall panel.
Figure 4B:
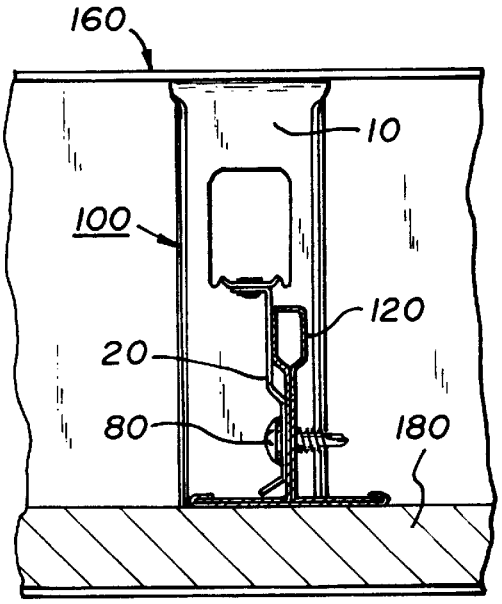
FIG. 4*b* is a cross-sectional end view of a "T" grid beam with the clip and the COMPASSO™ trim mounted thereon, according to the mounting configuration of FIG. 3. The clip is shown vertically adjusted on the "T" grid beam to accommodate a ⅝ inch thick drywall panel.

Since the clip 100 is vertically adjustable with respect to the "T" grid beam 120, it can be used with various thicknesses of horizontal ceiling panels 180. FIG. 4*a* illustrates the adjusted vertical position of the clip 100 with respect to the "T" grid beam 120 when the ceiling is constructed using ½ inch thick horizontal ceiling panels 180'. FIG. 4*b* illustrates the adjusted vertical position of the clip 100 with respect to the "T" grid beam 120 when the ceiling is constructed using ⅝ inch thick horizontal ceiling panels 180. Since the horizontal ceiling panel 180 in FIG. 4*b* is thicker than the horizontal ceiling panel 180' in FIG. 4*a*, the bracket portion 20 of the clip 100 is disposed in a lower position against the web portion 124 of the "T" grid beam 120.

FIG. 5 shows the clip 100 mounted in a reverse configuration to a "T" grid beam 120 intersecting the floating edge of the ceiling at a non-right angle. The clip 100 is mounted in the reverse configuration because the angle of intersection of the "T" grid beam 120 and the ceiling edge does not allow enough room for an installer to manually access and fasten the bracket portion 20 of the clip 100 to the side of the "T" grid beam closest to the COMPASSO™ trim 160, i.e. within the acute angle of the intersection. In this configuration, the bracket portion 20 of the clip 100 is placed against the "T" grid beam with the web bearing surface 26 and the bulb bearing surface 28 of the grid beam bearing portion 24 within the obtuse, or supplemental, angle of the intersection, facing away from the web portion 124 and bulb portion 126 of the "T" grid beam 120. The bent or flared, horizontal bottom edge 29 of the bracket portion 20 bears against the web portion 124 of the "T" grid beam 120 and provides support for the bracket portion 20 when a screw 80 is fastened through one of the vertical slots 32 in the bracket portion 20 to screw-engage the web portion 124 of the "T" grid beam 120.

Figure 6:
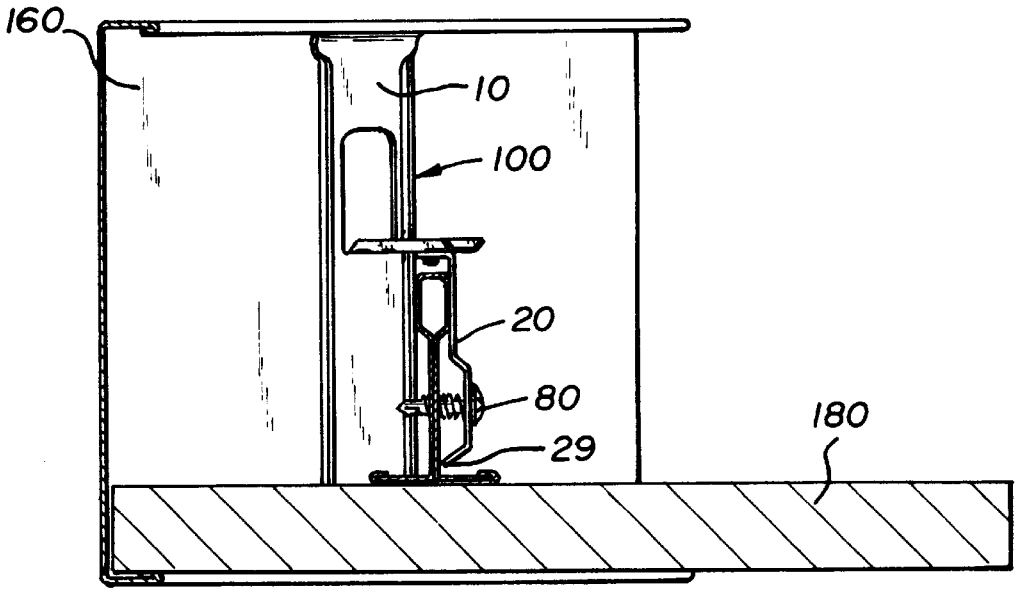
FIG. 6 is a cross-sectional end view of a "T" grid beam with the clip and COMPASSO™ trim mounted thereon, according to the mounting configuration of FIG. 5. The clip is shown vertically adjusted to accommodate a ⅝ inch thick drywall panel.

The vertical adjustment procedure for the reverse configuration of FIG. 5 is the same as that for the standard configuration of FIG. 3. The vertical position of the bracket portion 20 can be slid upwardly since the screw 80 is fastened through one of the vertical slots 32 in the bracket portion 20. The lower flange 162 of the COMPASSO™ trim 160 can be adjusted in this manner to eliminate any gaps that may exist between the lower flange 162 and the horizontal ceiling panel 180. FIG. 6 shows the bracket portion 20 of the clip 100 vertically adjusted relative to the "T" grid beam 120 to accommodate a ⅝ inch thick horizontal ceiling panel 180. When proper adjustment has been achieved, the clip 100 is secured to the "T" grid beam 120 by fastening a screw 80 through one of the holes 34 into the bulb portion 126 of the "T" grid beam 120, as shown in FIG. 5. This prevents the bracket portion 20 from moving relative to the screw 80 at one of the slots 32. The COMPASSO™ trim 160 may then be removed during the finishing process of the ceiling because the adjusted vertical position of the COMPASSO™ trim 160 is fixed. After the ceiling is finished, the COMPASSO™ trim 160 may be reinstalled.

FIG. 7 shows the clip 100 mounted in the standard configuration for use with a "T" grid beam 120 that runs parallel to and along the ceiling edge. In this configuration, the trim-attaching portion 10 of the clip 100 is pivoted a full 90° with respect to the bracket portion 20, so that the face surface 11 of the trim-attaching portion 10 is also parallel to the "T" grid beam 120. This allows the COMPASSO™ trim 160 to be mounted parallel to the "T" grid beam 120 and thus, parallel to and along the ceiling edge. The clip 100 is then vertically adjusted with respect to the horizontal ceiling panel 180 in the same manner as in the configuration of FIG. 3. This method of adjustment allows the installer to cure any gaps between the horizontal ceiling panel 180 and the lower flange 162 of the COMPASSO™ trim 160. FIG. 8 shows the bracket portion 20 of the clip 100 adjusted with respect to the "T" grid beam 120 to accommodate a ⅝ inch thick horizontal ceiling panel 180.

When proper adjustment has been achieved, the clip 100 can be secured to the "T" grid beam 120 by fastening the bracket portion 20 of the clip 100 to the web portion 126 of the "T" grid beam 120 through one of the holes 34 in the bracket portion 20. Since the proper position of the COMPASSO™ trim 160 may be secured at this point in the installation process, the COMPASSO™ trim 160 can be removed during the finishing steps of the ceiling without losing the properly adjusted position. Removal of the COMPASSO™ trim 160 during the finishing process of the ceiling prevents any possible damage that may occur from taping, sanding, painting or other finishing processes. When the ceiling is finished, the COMPASSO™ trim 160 can be reinstalled.

While specific embodiments of the present invention have been shown in the Figures for the purposes of explaining preferred and alternate embodiments of the invention, it is to be understood that the appended claims have a wide range of equivalents and a broader scope than the embodiments disclosed.

What is claimed is:

1. A clip for connecting trim at suspension grid ceiling edges in suspended ceiling systems comprising:

a trim-attaching portion having flanges at each end and a pivot structure there between;

a bracket portion having a bracket flange and a grid beam bearing portion, the bracket flange of the bracket portion pivotally connected to the pivot structure of the trim-attaching portion; and vertical slots in said grid beam bearing portions.

2. The clip as recited in claim 1, wherein the grid beam bearing portion comprises a bulb bearing surface and a web bearing surface, the web bearing surface being parallel to and offset from the bulb bearing surface.

3. The clip as recited in claim 2, wherein the web bearing surface has said vertical slots there through.

4. The clip as recited in claim 2, wherein the bulb bearing surface having holes therethrough.

5. The clip as recited in claim 1, wherein the bracket flange of the bracket portion is pivotally connected to the pivot structure of the trim-attaching portion by a rivet therethrough.

6. The clip as recited in claim 1, wherein the clip is metal.

7. The clip as recited in claim 6, wherein the clip is 22 gauge galvanized steel.

8. A ceiling edge in a suspended grid ceiling system comprising:

a grid beam having a web portion intersecting the ceiling edge;

a clip having a trim-attaching portion pivotally connected to a bracket portion, the bracket portion having a grid beam bearing portion, said clip adjustably mounted to the grid beam, and the grid beam portion having a surface thereof bearing against the web portion of the grid beam;

a ceiling panel mounted to the grid beam; and a face trim attached to the trim-attaching portion of said clip.

9. The ceiling edge in a suspended grid ceiling system of claim 8, wherein the grid beam transversely intersects the ceiling edge.

10. The ceiling edge in a suspended grid ceiling system of claim 8, wherein the grid beam intersects the ceiling edge at a non-right angle.

11. A ceiling edge in a suspended grid ceiling system comprising:

a grid beam having a web portion intersecting the ceiling edge at an angle;

a clip having a trim-attaching portion pivotally connected to a bracket portion, the bracket portion having a grid beam bearing portion, said clip adjustably mounted to the grid beam, permitting adjustment in the vertical direction, and the grid beam portion having a surface thereof bearing against the web portion of the grid beam;

a ceiling panel mounted to the grid beam; and a face trim attached to the trim-attaching portion of said clip.

12. A ceiling edge in a suspended grid ceiling system comprising:

a grid beam having a web portion positioned parallel to the ceiling edge;

a clip having a trim-attaching portion pivotally connected to a bracket portion, the bracket portion having a grid beam bearing portion, said clip mounted to the grid beam, and the grid beam bearing portion having a surface thereof bearing against the web portion of the grid beam;

a ceiling panel mounted to the grid beam; and a face trim attached to the trim-attaching portion of said clip.

13. A method of finishing a floating edge in a suspended grid ceiling comprising the steps of:

attaching a bracket portion of a clip to a grid beam transversely intersecting a ceiling edge by engaging a fastener at an aperture in the bracket portion of the clip and fastening the fastener;

pivoting a trim-attaching portion of the clip whereby a face surface thereof is parallel to the ceiling edge;

attaching a face trim to the trim-attaching portion;

loosening the fastener at the aperture in the bracket portion;

adjusting the position of the face trim by urging the face trim against a ceiling panel attached to the grid beam;

re-fastening the fastener, thereby maintaining the adjusted position of the trim-attaching portion with respect to the ceiling panel; and fastening the bracket portion of the clip to the grid beam with a second fastener.

14. A method of finishing a floating edge in a suspended grid ceiling comprising the steps of:

attaching a bracket portion of a clip to a grid beam intersecting a ceiling edge at an angle by engaging a fastener at an aperture in the bracket portion of the clip and fastening the fastener;

pivoting a trim-attaching portion of the clip whereby a face surface thereof is parallel to the ceiling edge;

attaching a face trim to the trim-attaching portion;

loosening the fastener at the aperture in the bracket portion;

adjusting the position of the face trim by urging the face trim against a ceiling panel attached to the grid beam;

re-fastening the fastener, thereby maintaining the adjusted position of the trim-attaching portion with respect to the ceiling panel; and fastening the bracket portion of the clip to the grid beam with a second fastener.

15. A method of finishing a floating edge in a suspended grid ceiling comprising the steps of:

attaching a bracket portion of a clip to a grid beam extending along a ceiling edge by engaging a fastener at an aperture in the bracket portion of the clip and fastening the fastener;

pivoting a trim-attaching portion of the clip whereby a face thereof surface is parallel to the ceiling edge and to the grid beam;

attaching a face trim to the trim-attaching portion;

loosening the fastener at the aperture in the bracket portion;

adjusting the position of the face trim by urging the face trim against a ceiling panel attached to the grid beam;

re-fastening the fastener, thereby maintaining the adjusted position of the trim-attaching portion with respect to the ceiling panel; and fastening the bracket portion of the clip to the grid beam with a second fastener.

* * * * *